United States Patent [19]

Hunter

[11] Patent Number: 5,052,258

[45] Date of Patent: Oct. 1, 1991

[54] CUTTER

[76] Inventor: Theodore K. Hunter, 6305 Buena, Atascadero, Calif. 93422

[21] Appl. No.: 664,469

[22] Filed: Mar. 1, 1991

Related U.S. Application Data

[63] Continuation of Ser. No. 324,083, Mar. 16, 1989, abandoned.

[51] Int. Cl.[5] ..... B26F 1/44

[52] U.S. Cl. ..... 83/589; 83/681; 83/682; 83/597; 30/229; 30/359

[58] Field of Search ..... 83/588, 589, 611, 681, 83/682, 694, 597; 30/178, 229, 359, 363, 367

[56] References Cited

U.S. PATENT DOCUMENTS

| | | | |
|---|---|---|---|
| 384,532 | 6/1888 | Knowlton | 83/682 |
| 893,669 | 7/1908 | Steel | 30/229 |
| 1,653,057 | 12/1927 | McGill | 30/363 |
| 2,161,994 | 6/1939 | Burns et al. | 83/661 |
| 2,370,319 | 2/1945 | Lippincott | 83/597 |
| 2,558,567 | 6/1951 | Kaeser | 83/589 |
| 2,708,312 | 5/1955 | Hauser | 30/178 |
| 3,166,968 | 1/1965 | Krouskop | 83/681 |
| 3,194,103 | 7/1965 | Gilman | 83/589 |
| 4,124,937 | 11/1978 | Gaught, Jr. | 83/917 |
| 4,240,572 | 12/1980 | Mitsuhashi | 83/597 |
| 4,503,744 | 3/1985 | Garner et al. | 83/589 |

*Primary Examiner*—Frank T. Yost
*Assistant Examiner*—Scott A. Smith
*Attorney, Agent, or Firm*—Daniel C. McKown

[57] ABSTRACT

A cutter for repeatedly cutting identical size pieces from a larger sheet of a semi-brittle and semi-rigid material includes an outer jaw affixed to a base and an inner jaw affixed to an arm that is resiliently connected to the base. The upper jaw includes a non-planar cutting edge that initiates the cut simultaneously at two locations located respectively on the right and left sides of the inner jaw and approximately midway between the front and rear of the inner jaw so as to produce a progressive scissors-like cutting action that proceeds simultaneously both forwardly and rearwardly from the aforesaid two locations and continues along the desired path.

5 Claims, 2 Drawing Sheets

CUTTER

This application is a continuation of application Ser. No. 07/324,083 filed Mar. 16, 1989 now abandoned.

BACKGROUND OF THE INVENTION

1. Field of the Invention

The present invention is in the field of tools, and more specifically relates a cutter for repeatedly cutting out pieces having identical shape from a sheet of a semi-brittle and semi-rigid material, such as resin-backed grinding disks.

2. The Prior Art

The present invention enables a worker to purchase a large, standard-size resin-backed grinding disk and to cut from it several smaller size grinding disks. The smaller disks are more convenient for detail work. The large standard-size disk is circular in shape and includes a center mounting hole. The smaller disks produced by the cutter must also have a center mounting hole, and, depending on the shape of the jaws of the cutter, the smaller disks can be either circular or polygonal.

The extensive prior art in the field of cutters includes cutters for almost everything from doughnuts to paper. However, the cutting of resin-backed grinding disks has thus far proven to be difficult to accomplish. Such disks are extraordinarily tough and nearly rigid. Further, one side of the grinding disk is practically covered with large particles of grit, which is very securely bonded to the disk. Because of the presence of the grit and a tendency for the resin to fracture in a brittle manner, it has been difficult to obtain a clean edge on the pieces cut from such material. The present invention provides a satisfactory solution to the problem of cutting such grinding disks.

Although the cutter of the present invention is novel combination of structural components, some of the components are old in the art.

For example, in U.S. Pat. No. 2,227,575 issued Jan. 7, 1941 to Eliel, et al., there is shown an adjustable center post for use in selectively positioning the sheet of material to be cut with respect to the cutting edges.

Also, in U.S. Pat. No. 2,598,042 issued May 27, 1952 to Dritz, there is shown a hole cutter that is mounted on a resilient U-shaped member.

U.S. Pat. No. 2,185,005 issued Dec. 26, 1939 to Wagner shows a perforator that is made of sheet metal and is used on paper.

As will be seen below, the cutter of the present invention includes structural features that distinguish it from the cutters of the prior art and that uniquely enable it to accomplish the desired cutting on a very difficult material.

SUMMARY OF THE INVENTION

It is an object of the present invention to provide a cutter for cutting out pieces from a sheet of resin-backed grinding disk.

It is a further object of the present invention to provide a cutter that can produce a clean cut in a resin-backed grinding disk.

In accordance with the present invention, these objectives are achieved by the use of a pair of cutting jaws. The lower cutting jaw having a cutting edge that lies in a plane, and the upper cutting jaw having a non-planar cutting edge that is tapered most sharply at the points of initial contact and which produces a progressive scissors-like cutting action that proceeds simultaneously both forwardly and rearwardly from the two starting locations and continues along the closed path that defines the shape of the piece being cut out.

The novel features which are believed to be characteristic of the invention, both as to organization and method of operation, together with further objects and advantages thereof, will be better understood from the following description considered in connection with the accompanying drawings in which a preferred embodiment of the invention is illustrated by way of example. It is to be expressly understood, however, that the drawings are for the purpose of illustration and description only and are not intended as a definition of the limits of the invention

DETAILED DESCRIPTION OF THE PREFERRED EMBODIMENT

Figure 1:
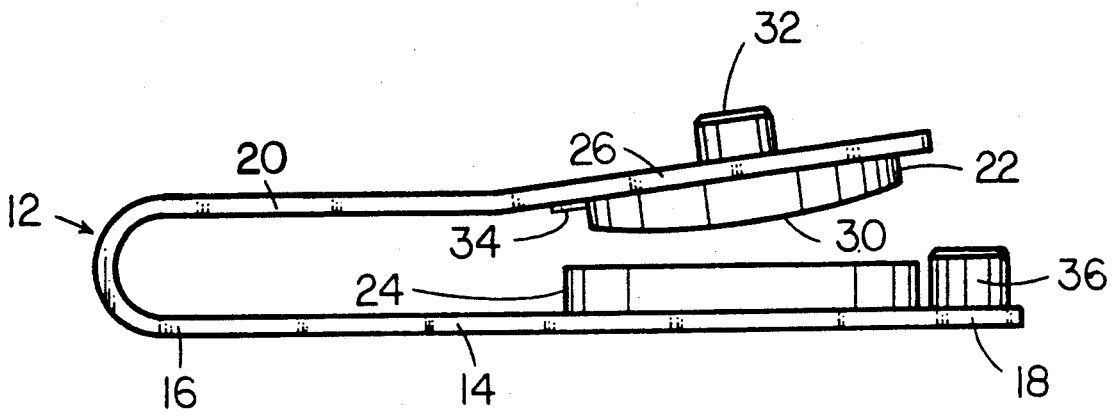
FIG. 1 is a right side elevational view showing a preferred embodiment of the cutter of the present invention.
Figure 2:
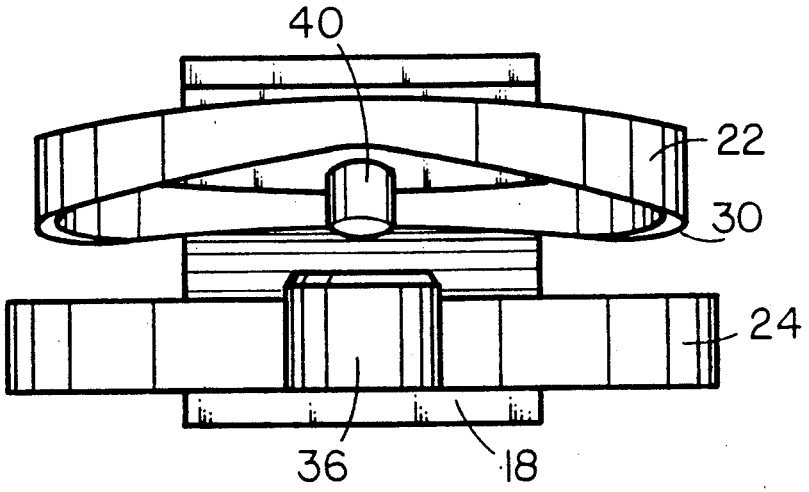
FIG. 2 is a front elevational view of the embodiment of FIG. 1.
Figure 3:
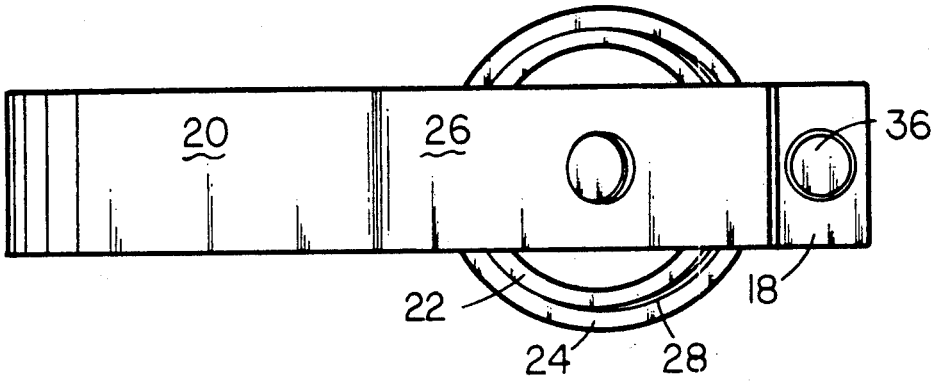
FIG. 3 is a top plan view of the embodiment of FIG. 1.

FIGS. 1-3 show a preferred embodiment of the invention in its normal uncompressed condition. The inner jaw 22 and the outer jaw 24 are held in the positions shown by a generally U-shaped resilient member 12. This member is composed of steel in the preferred embodiment. Extending from the U-shaped resilient member 12 are a base 14 and an arm 20. The bottom of the base 14 is flat so that it will sit on a bench or floor. The base 14 includes a rear end 16 and a front end 18.

The arm 20 is resiliently connected to the base 14 so that a downward force applied to the arm 20, or preferably to the knob 32 by a sledge hammer, will press or drive the jaws 22, 24 closer together.

In the preferred embodiment shown in FIGS. 1-3, the inner jaw 22 and the outer jaw 24 are both ring-shaped, and the outer diameter of the inner jaw is approximately 0.125 inch less than the inner diameter of the outer jaw 24, so that when the jaws are closed, there is a gap of approximately 0.0625 inch between them. It should be noted that the cutting edge 28 (best seen in FIG. 3) of the outer jaw 24 lies in a plane, but the cutting edge 30 of the inner jaw 22 is non-planar. The non-planar curve of the cutting edge 30 of the inner jaw 22 is produced by passing the ring 22 in the direction of one of its diameters past a grinding wheel or cutter of large diameter that is spinning about an axis parallel to the chosen diameter. As a result, the lower side of the inner jaw 22 is tapered at its left and right extremities (as best seen in FIG. 2), but is flat at its front and rear extremities. As will be seen below, the tapered shape at either side of the inner jaw helps to facilitate penetration through the material to be cut.

As best seen in FIG. 1, a portion 26 of the arm 22 is inclined away from the base 14. As the arm 22 is driven closer to the base 14, the inner jaw 22 tilts forward, and the angle of inclination of the portion 26 is sufficient to insure that when the jaws come together, their axes coincide. This feature is often overlooked in the design of punches and cutters with the result that the jaws sometimes bind as they open, and sometimes produce a ragged edge on the cut part.

Another novel feature of the present invention is the chisel 34 which has the form of a downwardly directed wedge extending in the backward-forward direction. When the jaws are closed, the wedge 34 strikes the top of the outer jaw 24 to produce a radially extending cut through the material. This cut facilitates removal of the cut-out part from the remainder of the sheet of material being cut.

Figure 5:
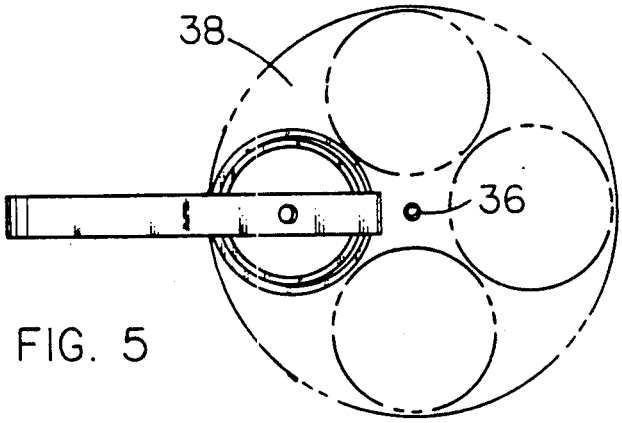
FIG. 5 is a top plan view similar to FIG. 3 but to a reduced scale, showing how the cutter of FIG. 1 is used to cut a number of smaller grinding disks from a larger grinding disk; and, FIG. 6 is a top plan view to the same reduced scale as FIG. 5, showing one of the smaller grinding disks made by use of the cutter of FIG. 1.

A centering post 36 is provided at the front end 18 of the base 14. The diameter of the centering post is the same as the diameter of the center hole in the large grinding disk. The disk is centered on the centering post 36 as shown in FIG. 5, and the disk is rotated about the centering post 36 so that smaller grinding disks can be cut from the large grinding disk.

In the preferred embodiment, a downward extension of the knob 32 passes through the portion 26 of the arm and extends below it to serve as a punch 40 that cooperates with a die affixed to the base 14 to punch a center hole 42 in the smaller grinding disk 44 that is produced by the cutter.

Figure 4:
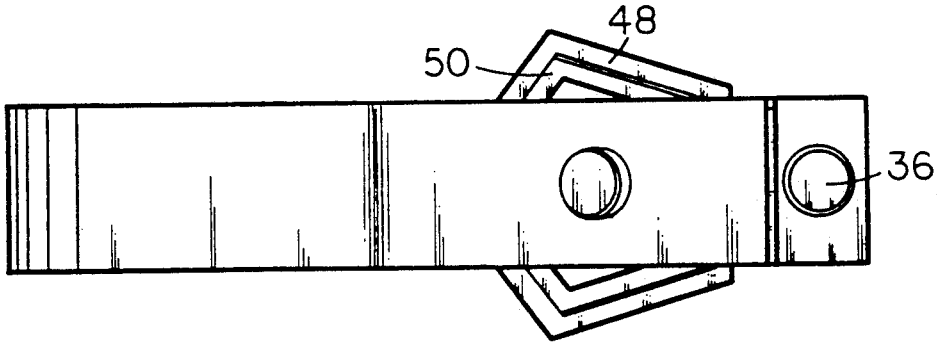
FIG. 4 is a top plan view of an alternative embodiment.

FIG. 4 shows an alternative embodiment in which the jaws 48, 50 have a pentagonal shape and produce smaller grinding disks of that shape.

Figure 6:
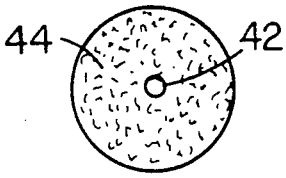

In operation, the cutter is placed on a bench or on the floor, and a large grinding disk 38 is mounted on the centering post 36 which passes through the center hole in the large grinding disk. Next, the user strikes the knob 32 with a downwardly directed blow by a sledge hammer. Thereafter, the piece cut out is removed from within the inner jaw 22 by the user extending his finger downwardly through the space between the inclined arm portion 26 and the inner jaw. Normally, the cut out piece is quite easily removed from the inner jaw 22. Thereafter, the user rotates the large grinding disk 38 approximately 90 degrees about the centering post 36, and, after placing the cutter on a bench or on the floor, again strikes the knob 32 with a sledge hammer to cut out a second smaller disk, such as the one shown in FIG. 6.

Thus, there has been described a cutter for repeatedly cutting identical smaller grinding disks from a larger grinding disk. The resin coated grinding disks are very tough and are somewhat brittle, so that cutting such a material is an altogether different problem from that of cutting such things as paper or vinyl. The most novel aspects of the present invention are the shape of the inner jaw and the provision of a chisel adjacent the jaw to facilitate removal of the remainder.

The foregoing detailed description is illustrative of one embodiment of the invention, and it is to be understood that additional embodiments thereof will be obvious to those skilled in the art. The embodiments described herein together with those additional embodiments are considered to be within the scope of the invention.

What is claimed is:

1. A cutter for repeatedly cutting out pieces having identical shape from a sheet of a semi-brittle and semi-rigid material, said cutter noteworthy for producing a clean cut in such material and comprising:

a base, elongated and extending in its direction of elongation from a rear end to a front end, and extending laterally to the left and right;

an arm, elongated in the same direction as said base, located above said base but spaced from it, said arm having a first portion resiliently connected at a first end to the rear end of said base for resiliently opposed motion toward said base, said arm having a second portion inclined away from said base and said first portion and attached at one end to a second end of said first portion so as to extend forward from said first portion, said arm elastically deformable in response to an applied downward force to reduce the inclination of said second portion with respect to said first portion whereby the effective length of said arm is increased as the stroke progresses.

2. The cutter of claim 1 further comprising:

an outer jaw affixed to said base, having a cutting edge that lies in a plane, that defines a closed geometric figure in that plane, and that extends to the left and right as well as forwardly and rearwardly;

an inner jaw affixed to said arm and extending to the left and right as well as forwardly and rearwardly;

said inner jaw and said outer jaw located opposite each other between said arm and said base;

said inner jaw slightly smaller than said outer jaw so that as said arm is pressed toward said base, said inner jaw protrudes into said outer jaw;

said inner jaw having a non-planar cutting edge which, as said arm is pressed toward said base, first enters said outer jaw at two locations located respectively on the right and left sides of said outer jaw and approximately midway between the front and rear of said outer jaw so as to produce a progressive scissors-like cutting action that proceeds simultaneously both forwardly and rearwardly from said two locations and continues along the closed geometric figure.

3. The cutter of claim 2 wherein the non-planar cutting edge of said inner jaw, when viewed in the front-to-rear direction, has the shape of an arc of a circle.

4. The cutter of claim 2 wherein a portion of said base extends forward beyond said outer jaw, and further comprising a centering post extending upwardly from said portion of said base.

5. The cutter of claim 2 further comprising a chisel affixed to said arm adjacent said inner jaw and striking said outer jaw when the jaws are fully closed, whereby a cut is produced in the sheet of semi-brittle and semi-rigid material.

* * * * *